US007207957B2

(12) United States Patent
Szczepanski

(10) Patent No.: US 7,207,957 B2
(45) Date of Patent: Apr. 24, 2007

(54) MASSAGER FOR A THREE-HEADED ROTARY DRIVE

(76) Inventor: Ryszard Szczepanski, 14500 SW. 71 Ln., Miami, FL (US) 33183

( * ) Notice: Subject to any disclaimer, the term of this patent is extended or adjusted under 35 U.S.C. 154(b) by 418 days.

(21) Appl. No.: 10/810,028

(22) Filed: Mar. 26, 2004

(65) Prior Publication Data

US 2004/0260213 A1 Dec. 23, 2004

Related U.S. Application Data

(60) Provisional application No. 60/480,610, filed on Jun. 23, 2003.

(51) Int. Cl.
*A61H 15/00* (2006.01)

(52) U.S. Cl. ..... 601/112; 601/113

(58) Field of Classification Search ..... 601/112–113, 601/107, 110

See application file for complete search history.

(56) References Cited

U.S. PATENT DOCUMENTS

| | | | | |
|---|---|---|---|---|
| 1,936,022 | A * | 11/1933 | Hunt | 601/110 |
| 2,448,846 | A | 9/1948 | Trochim | |
| 2,519,790 | A * | 8/1950 | Quinn | 601/6 |
| 2,709,432 | A | 5/1955 | Ackerman | |
| 2,797,685 | A | 7/1957 | Packwood | |
| 3,104,662 | A | 9/1963 | Morawetz | |
| 3,314,417 | A | 4/1967 | Starre et al. | |
| 3,314,418 | A | 4/1967 | Tiemes | |
| 4,027,348 | A | 6/1977 | Flowers et al. | |
| 4,184,088 | A | 1/1980 | Richert | |
| 4,840,085 | A * | 6/1989 | Nagano | 74/594.4 |
| 4,858,600 | A | 8/1989 | Gross et al. | |
| 4,887,594 | A | 12/1989 | Siegel | |
| 4,918,818 | A | 4/1990 | Hsieh | |
| 5,105,802 | A * | 4/1992 | Pokorny | 601/131 |
| 5,131,147 | A | 7/1992 | Plevyak et al. | |
| 5,131,384 | A | 7/1992 | Obagi | |
| 5,133,130 | A | 7/1992 | Podolsky | |
| 5,280,906 | A * | 1/1994 | Vitale | 473/613 |
| 5,725,483 | A | 3/1998 | Podolsky | |
| 6,432,071 | B1 | 8/2002 | Hsieh | |

* cited by examiner

*Primary Examiner*—Michael A. Brown
(74) *Attorney, Agent, or Firm*—Laurence A. Greenberg; Werner H. Stemer; Ralph E. Locher

(57) ABSTRACT

A massager can be attached to and driven by a rotary drive. The massager has a massager head, which includes a substantially spherical core having an uninterrupted curved surface section. A cover section surrounds the spherical core and a drive shaft is connected to the spherical core. The massager has a connector for attaching the massager to the rotary drive. The massager also includes an attachment for transferring rotary motion from the drive to the drive shaft.

21 Claims, 5 Drawing Sheets

FIG. 2
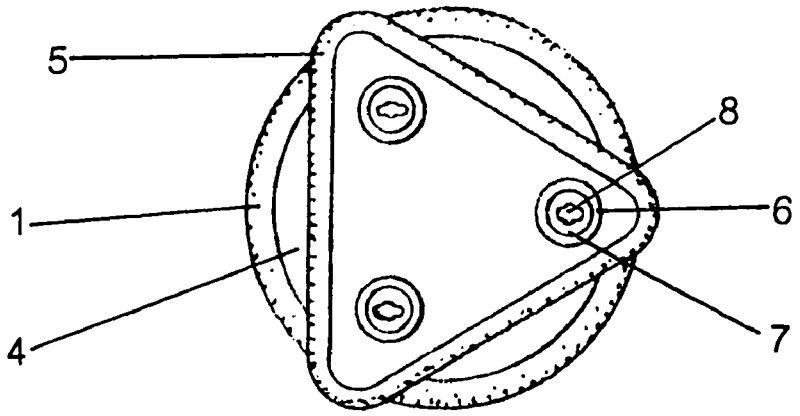
FIG. 1
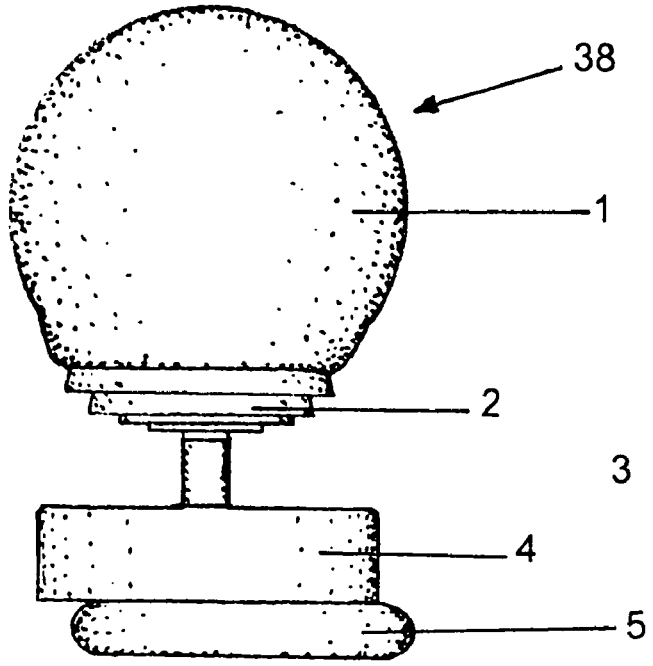
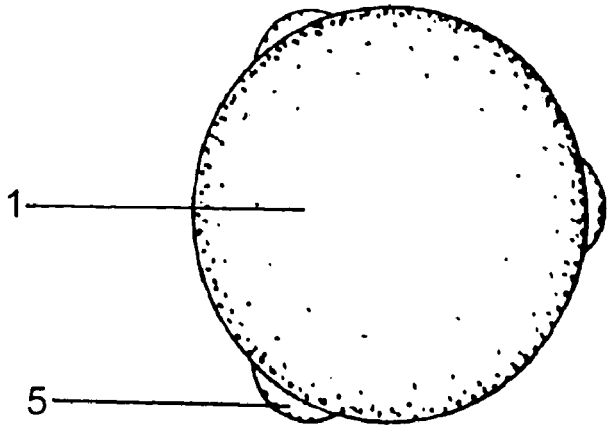
FIG. 3

MASSAGER FOR A THREE-HEADED ROTARY DRIVE

CROSS-REFERENCE TO RELATED APPLICATION

This application claims the benefit under 35 U.S.C. § 119(e) of copending provisional application No. 60/480,610 filed Jun. 23, 2003.

BACKGROUND OF THE INVENTION

1. Field of the Invention

The invention relates to an apparatus that can be used as a compact massager, more specifically, to a massager that can be attached to an electric drive having three rotary heads and which can be used as facial or body massager.

2. Description of the Related Art

U.S. Pat. No. 5,131,384 (Obagi) discloses a combination applicator massager that can simultaneously apply a fluid to an area that is to be massaged. The massager has a reservoir for holding the fluid and a ball retainer having recesses for holding the rotatable balls in position. A metering plate is constructed to feed the fluid to the individual balls, which allows the fluid to reach the area to be massaged.

U.S. Pat. No. 5,105,802 (Pokorny) discloses a device for working a conditioning substance on a surface. The device includes a body with a motor and a head. The head includes a rotating head and a fixed head. The rotating head includes rotating massage elements. The motor in the body drives the rotating head and the rotating massage elements.

U.S. Pat. No. 5,725,483 (Podolsky) discloses a massaging device having a plurality of massaging members mounted on a universal head. Each of the massaging elements is rotatable about a respective orbit and movable toward and away from a center of the head.

U.S. Pat. No. 4,858,600 (Gross et al.) discloses a massaging appliance for massaging a face or any other body part. The massaging device includes a housing with a motor that drives a cream applicator. The cream applicator has a first end wall with a plurality of openings each occupied by a ball rotatably mounted therein for dispensing cream to the contacted part of the body.

The above-mentioned prior art references have the disadvantages that none of the references discloses a massager that can be mounted to a standard rotary drive, such as a razor. Furthermore, the prior art does not disclose massagers that have a substantially spherical rotating core that is surrounded by several layers that are capable of maintaining a lubricant and air pressure between the layers and the core. Furthermore the prior does not disclose an outer cover that can be shifted to accommodate the contours of a user's face, neck, or other body profiles.

SUMMARY OF THE INVENTION

It is accordingly an object of the invention to provide a massager which overcomes the above-mentioned disadvantages of the heretofore-known devices and methods of this general type, which can be readily attached to an existing electric drive having three heads, for example to a rotary razor, and which is a comfortable facial or body massager.

With the foregoing and other objects in view there is provided, in accordance with the invention, in combination with a rotary drive, a massager for attachment to the drive. The massager having a massager head including a substantially spherical core, and having an uninterrupted curved surface section. A cover assembly surrounding the spherical core and a drive shaft connected to the spherical core. A connector for attaching the massager to the drive and an attachment for transferring rotary motion from the drive to the drive shaft.

In accordance with another feature of the invention, there is provided a tubular sleeve surrounding the drive shaft.

In accordance with a further feature of the invention, the cover assembly includes a solid rubber layer having an opening formed therein with a thickened shoulder region surrounding the opening. A sponge layer attached to the solid rubber layer, a cotton fabric cover having an opening formed therein with an attachment ring surrounding the opening attaching the cotton fabric cover to the thickened shoulder region. A corrugated layer of rubber attached to the solid rubber layer and abutting the tubular sleeve, the corrugated rubber layer being slideable on the uninterrupted curved surface section.

In accordance with an added feature of the invention, the corrugated layer of rubber has panel sections and folded connector sections interconnecting the panel sections.

In accordance with an additional feature of the invention, the corrugated layer of rubber includes an end section having a hooking feature with a substantially T-shaped cross section for sealingly attaching the corrugated layer of rubber to the thickened shoulder region of the solid rubber layer. The corrugated layer of rubber has a drive shaft cover surrounding the drive shaft and abutting the tubular sleeve.

In accordance with an additional feature of the invention, the thickened shoulder region includes a one-way valve for providing a higher than atmospheric pressure between the cover assembly and the core.

In accordance with yet another feature of the invention, the drive shaft cover includes a sealing projection at the drive shaft for maintaining the higher than atmospheric pressure in the cover assembly.

In accordance with yet a further feature of the invention, the drive shaft includes a taper for seating the core on the drive shaft, and the drive shaft has a threaded end for receiving a nut.

In accordance with yet an added feature of the invention, the core has a recess for receiving the nut, the recess has a cover for covering the recess and the nut.

In accordance with yet an additional feature of the invention, the core is a substantially spherical motion-core having beveled surfaces for receiving balls.

In accordance with still another feature of the invention, the balls include balls of two different sizes.

In accordance with still a further feature of the invention, the core is a substantially spherical static-core having grooves and high spots.

In accordance with still an added feature of the invention, one of the grooves is substantially perpendicular to the drive shaft, and defines the uninterrupted curved surface section.

In accordance with still an additional feature of the invention, the rotary drive is a razor.

In accordance with another feature of the invention, the rotary drive is a three-headed drive.

In accordance with a further feature of the invention, the attachment is a gearbox.

With the objects of the invention in view, there is also provided, in combination with a rotary drive, a massager for attachment to the drive, the massager having a massager head including a substantially spherical motion-core having an uninterrupted curved surface section, beveled surfaces and balls disposed at the beveled surfaces. A cover assembly surrounding the motion-core, the cover assembly including a solid rubber layer, a sponge layer attached to the solid rubber layer, a cotton fabric cover, and a corrugated layer of rubber attached to the solid rubber layer. The corrugated rubber layer being slideable on the uninterrupted curved surface section. A drive shaft connected to the motion-core. A connector for attaching the massager to the drive and an attachment for transferring rotary motion from the drive to the drive shaft.

In accordance with an added feature of the invention, there is provided a tubular sleeve surrounding the drive shaft, the tubular sleeve abutting the corrugated rubber layer.

With the objects of the invention in view, there is furthermore provided, in combination with a rotary drive, a massager for attachment to the drive, the massager having a massager head including a substantially spherical static-core having grooves defining high spots and an uninterrupted curved surface section. A cover assembly surrounding the static-core, the cover assembly including a solid rubber layer, a sponge layer attached to the solid rubber layer, a cotton fabric cover, and a corrugated layer of rubber attached to the solid rubber layer. The corrugated rubber layer being slideable on the uninterrupted curved surface section. A drive shaft connected to the static-core. A connector for attaching the massager to the drive and an attachment for transferring rotary motion from the drive to the drive shaft.

In accordance with an additional feature of the invention, there is provided a tubular sleeve surrounding the drive shaft, the tubular sleeve abutting the corrugated rubber layer.

Other features which are considered as characteristic for the invention are set forth in the appended claims.

Although the invention is illustrated and described herein as embodied in the massager, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic, side-elevational view of the massager according to the invention;

FIG. 2 is a plan view of the massager according to FIG. 1 as seen from the drive side of the massager;

FIG. 3 is a plan view of the massager according to FIG. 1 as seen from the massaging side of the massager;

DESCRIPTION OF THE PREFERRED EMBODIMENTS

Figure 7:
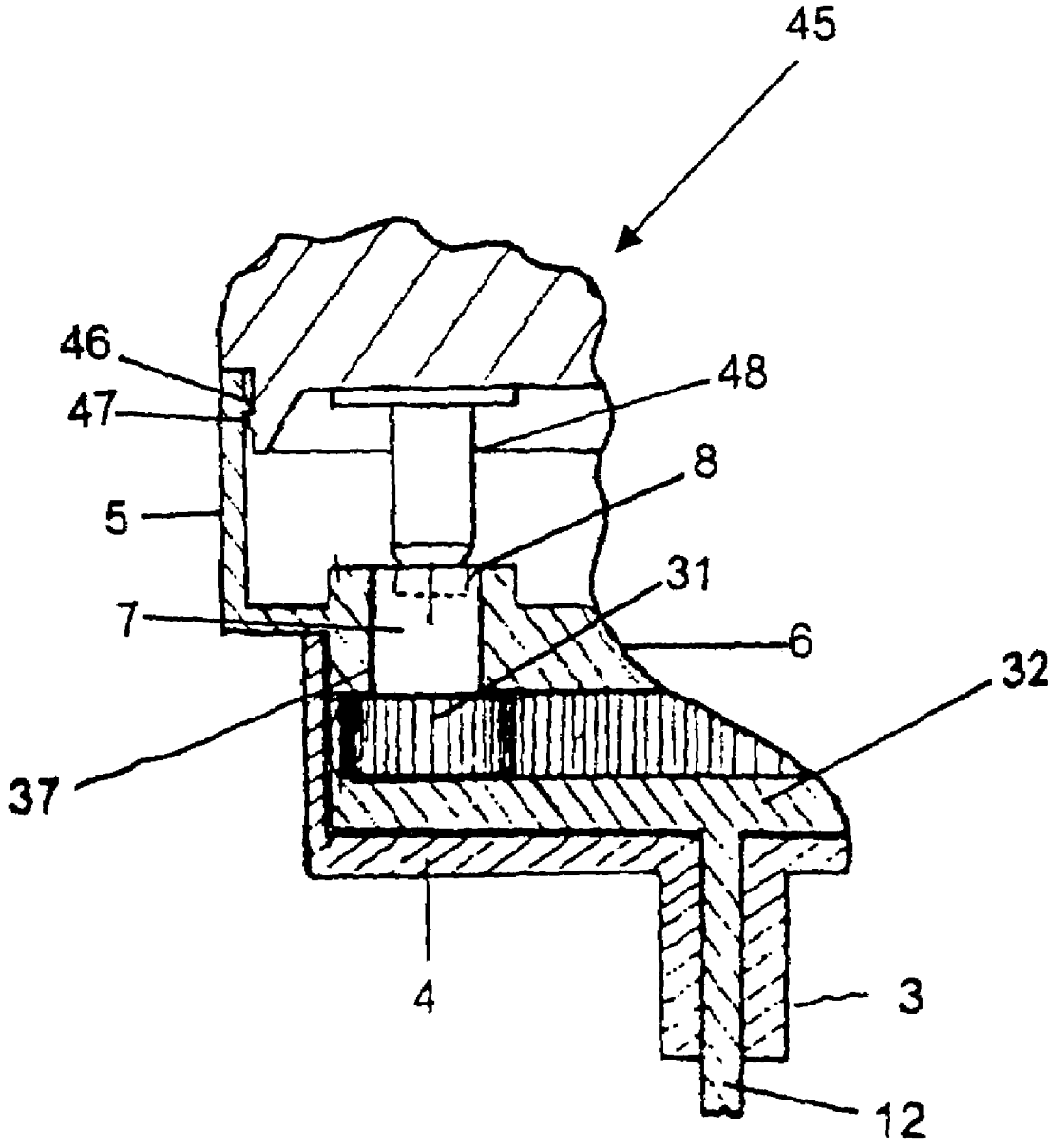
FIG. 7 is a partial sectional view through a drive of the massager according to FIG. 1 showing the gear drive of the massager and the attachment of the massager to the electric drive.

Referring now to the figures of the drawing in detail and first, particularly, to FIGS. 1–3 thereof, there is seen a massager 38 according to the invention. The massager 38 has a massager head 1 that performs the actually massaging. It is possible for the massager head 1 to be driven by a drive unit such as a Norelco Reflex Plus (model number 6423 LC) rotary razor 45, part of which is shown in FIG. 7. FIG. 7 also shows that the massager has a gearbox 4 with a cover 6 having a connector 5. The connector 5 includes tabs 46, which mate with retractable tabs 47 of the razor 45 to hold the massager 38 in place on the razor 45. As can be seen in FIGS. 2 and 7, the cover 6 includes the connector 5 and bearing surfaces 37 for shafts 7. The shafts 7 include the appropriate end fittings 8, which mate with rotary drive heads 48 of the razor 45. Different razors or rotary drives can be attached to the massager 38 by appropriately adapting the connector 5 and end fittings 8 of the shafts 7. In fact, any drive having the drive heads 48 and tabs 47 can be used to drive the massager without adaptation. Also seen in FIG. 7 is one of three pinions 31 which are attached to the shafts 7. The pinions 31 drive a gear 32 in a rotating manner, which in turn imparts a rotary motion to a drive shaft 12. An optional tubular sleeve 3 surrounds the drive shaft 12. Furthermore, for a rotary drive source that does not have offset or multiple drive heads, the gearbox 4 can be an attachment, which simply connects the drive shaft 12 of the massager directly to an output shaft or head of the rotary drive.

Figure 4:
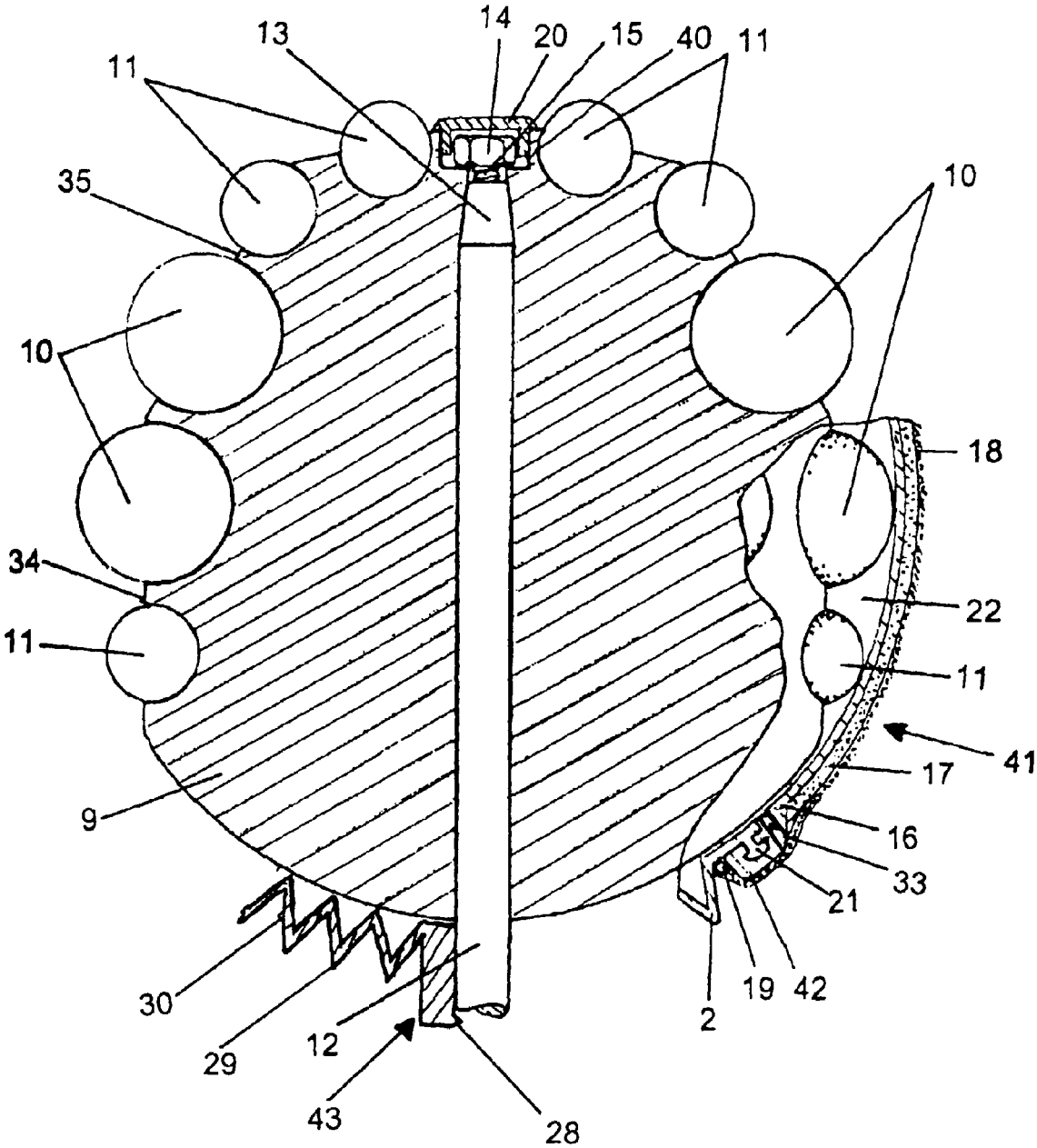
FIG. 4 is a partly broken-away, sectional view through the core of the massager according to FIG. 1 showing an embodiment with a motion-core.
Figure 5:
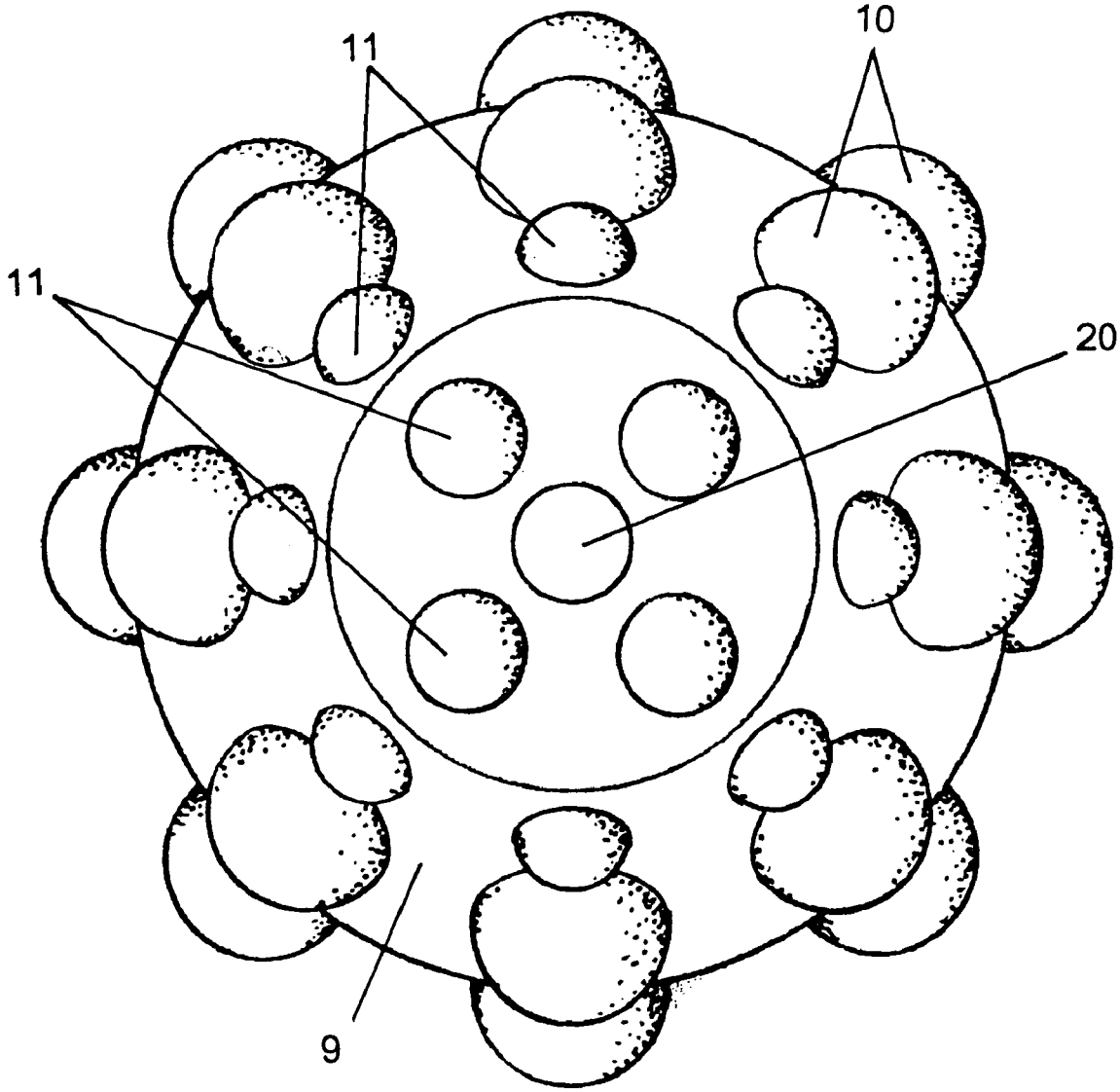
FIG. 5 is a plan view of the massager according to FIG. 1 showing the embodiment with the motion-core without its cover layers as seen from the massaging side of the massager.

As can be seen in the embodiment shown in FIGS. 4 and 5, a substantially spherical motion-core 9 includes balls 10, 11, which are positioned in the motion-core 9. The balls 10, 11 are of different sizes. The motion-core 9 has beveled surfaces 34, 35 that allow the balls 10, 11 to be positioned in the core 9 so that a sphere of a constant diameter is tangential to the surfaces of the balls 10 and 11. The motion core 9 also has an uninterrupted curved surface 36. The drive shaft 12 passes through the substantially spherical motion-core 9 of the massager and is seated on a taper 13. The shaft 12 is fixed to the motion-core 9 by a nut 14 attached to a threaded end 15 of the drive shaft 12. The nut 14 fits into a recess 40 of the motion-core 9. The recess 40 is provided with a plug or cap 20, which covers the top of the recess 40. It is noted that any other suitable measure for attaching the motion-core 9 to the drive shaft 12 can be used, such as a bayonet connection.

The motion-core 9 includes a cover assembly 41 that is made of a layer of solid rubber 16 having an opening with a thickened shoulder region 42. The solid rubber layer 16 has a layer of sponge material 17 that is attached to the solid rubber layer 16. The sponge material 17 and the solid rubber layer are surrounded by a removable and washable elastic cotton fabric cover 18, which has an opening. The fabric cover 18 has an attachment ring 19 that surrounds the opening of the fabric cover 1 and which attaches to the rubber cover 16 at the thickened shoulder region 42.

A corrugated layer of rubber 2 collapses and expands by sliding on the uninterrupted curved surface 36 of the motion-core 9, which allows the cover assembly 41 to flex while the massager 38 is being moved along a surface to be massaged. The corrugated layer of rubber 2 includes panel sections 30 and folded connector sections 29, which connect the panel sections 30 to each other. An end of the corrugated layer of rubber 2 includes a substantially T-shaped hook feature 21 for sealingly attaching the solid rubber piece 16. The rubber piece 16 includes a mating profile in the thickened shoulder region 42 for the hook feature 21. It is also possible to provide the hook feature 21 on the solid rubber piece 16 and have the mating profile as part of the corrugated section 2. Furthermore, any method of sealingly attaching the rubber cover 16 to the corrugated layer of rubber 2 can be used. The corrugated layer of rubber 2 also includes a drive shaft cover 43 which surrounds the drive shaft 12 and which abuts the tubular sleeve 3. The construction of the cover layer 41 provides a void 22 between the layers 2, 16 and the motion-core 9. The void 22 can be filled with a lubricant. The void 22 can also be filled with air pressure via a one-way valve 33, by an end user using a hollow tube of an appropriate diameter. The drive shaft cover 43 has a sealing projection 28 that seals the cover assembly 41 with respect to the drive shaft 12.

Figure 6:
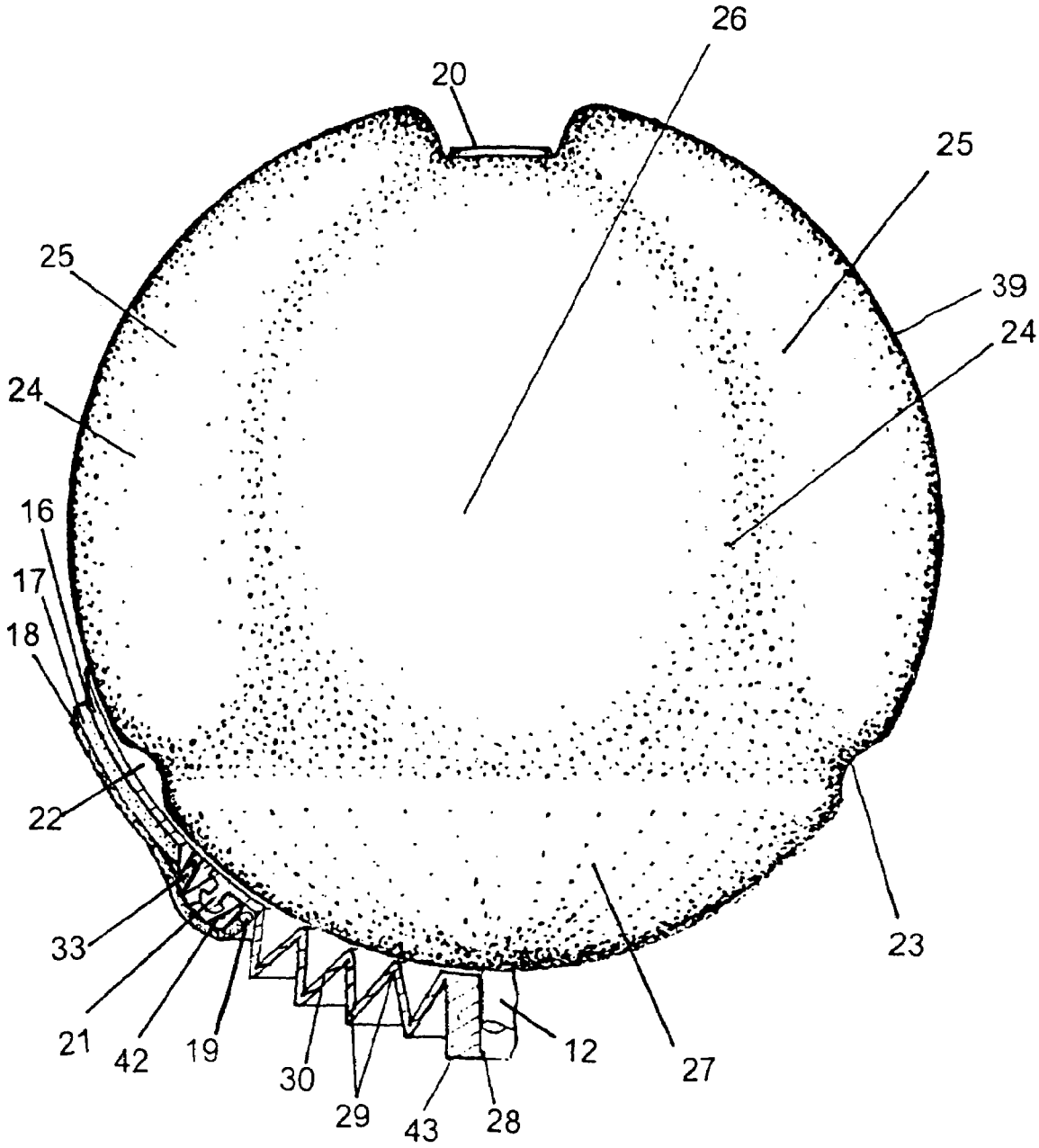
FIG. 6 is a partial sectional view through the covering of the core of the massager according to FIG. 1 showing an embodiment of the invention with a static-core.

FIG. 6 shows a partial section through the embodiment showing a substantially spherical static-core 39. As can be seen in FIG. 6, the static core 39 has high spots 25, 26 and low spots or grooves 23, 24. The grooves 23, 24 define the high spots 25, 26. The groove 23 is substantially perpendicular to the drive shaft 12 and also defines an uninterrupted curved surface 27 on the static core 39.

The drive mechanism for the static-core 39 is the same as in the embodiment of FIG. 4, which shows the motion-core 9. The drive shaft 12 passes through the substantially spherical static-core 39 of the massager. The shaft 12 is fixed to the static-core 39 by a nut 14 attached to a threaded end 15 of the drive shaft 12. The nut 14 fits into a recess 40 of the static-core 39. The recess 40 is provided with a plug or cap 20, which covers the top of the recess 40. It is noted that any other suitable measures for attaching static-core 9 to the drive shaft 12 can be used.

The static-core 39 includes a cover assembly 41 that is made of a layer of solid rubber 16 having an opening with a thickened shoulder region 42. The sponge material 17 and the solid rubber layer 16 are surrounded by a removable and washable elastic cotton fabric cover 18, which has an opening. The fabric cover 18 has an attachment ring 19 that surrounds the opening of the fabric cover 1 and which attaches to the rubber cover 16 at the thickened shoulder region 42.

A corrugated layer of rubber 2 collapses and expands by sliding on the uninterrupted curved surface 27 of the static-core 39, which allows the cover assembly to flex while the massager 38 is being moved along a surface to be massaged. The corrugated layer of rubber 2 includes panel sections 30 and folded connector sections 29, which connect the panel sections 30 to each other. An end 44 of the corrugated layer of rubber 2 includes a substantially T-shaped hook feature 21 for sealingly attaching the solid rubber piece 16. The rubber piece 16 includes a mating profile in the thickened shoulder region 42 for the hook feature 21. It is also possible to provide the hook feature 21 on the solid rubber piece 16 and have the mating profile as part of the corrugated section 2. Furthermore, any method of sealingly attaching the rubber cover 16 to the corrugated layer of rubber 2 can be used. The corrugated layer of rubber 2 also includes a drive shaft cover 43 which surrounds the drive shaft 12 and which abuts the tubular sleeve 3. The construction of the cover layer 41 provides a void 22 between the layers 2, 16 and the static-core 39. The void 22 can be filled with a lubricant. The void 22 can also be filled with air pressure via a one-way valve 33, by an end user using a hollow tube of an appropriate diameter. The drive shaft cover 43 has a sealing projection 28 that seals the cover assembly 41 with respect to the drive shaft 12.

I claim:

1. In combination with a rotary drive, a massager for attachment to the drive, the massager comprising:

a massager head including:

a substantially spherical core having an uninterrupted curved surface section;

a cover assembly surrounding said spherical core, said cover assembly having a corrugated rubber layer, said corrugated rubber layer being slideable on said uninterrupted curved section;

a drive shaft connected to said spherical core;

a connector for attaching the massager to the drive; and an attachment for transferring rotary motion from the drive to said drive shaft.

2. The massager according to claim 1, wherein said drive shaft includes a taper for seating said core on said drive shaft, and said drive shaft has a threaded end for receiving a nut.

3. The massager according to claim 2, wherein said core has a recess for receiving said nut, said recess has a cover for covering said recess and said nut.

4. The massager according to claim 1, wherein said core is a substantially spherical motion-core having beveled surfaces for receiving balls.

5. The massager according to claim 4, wherein said balls include balls of two different sizes.

6. The massager according to claim 1, wherein said core is a substantially spherical static-core having grooves and high spots.

7. The massager according to claim 6, wherein one of said grooves is substantially perpendicular to said drive shaft, and defines said uninterrupted curved surface section.

8. The massager according to claim 1, wherein said rotary drive is a razor.

9. The massager according to claim 1, wherein said rotary drive is a three-headed drive.

10. The massager according to claim 1, wherein said adaptor is a gearbox.

11. In combination with a rotary drive, a massager for attachment to the drive, the massager comprising:

a massager head including:

a substantially spherical core having an uninterrupted curved surface section;

a drive shaft connected to said spherical core;

a tubular sleeve surrounding said drive shaft;

a cover assembly surrounding said spherical core, said cover assembly including a solid rubber layer having an opening formed therein with a thickened shoulder region surrounding said opening, a sponge layer attached to said solid rubber layer, a cotton fabric cover having an opening formed therein with an attachment ring surrounding said opening for attaching said cotton fabric cover to said thickened shoulder region, and a corrugated layer of rubber attached to said solid rubber layer and abutting said tubular sleeve, said corrugated rubber layer being slideable on said uninterrupted curved surface section;

a connector for attaching the massager to the drive; and an attachment for transferring rotary motion from the drive to said drive shaft.

12. The massager according to claim 11, wherein said corrugated layer of rubber has panel sections and folded connector sections interconnecting said panel sections.

13. The massager according to claim 12, wherein said corrugated layer of rubber includes an end section having a hooking feature with a substantially T-shaped cross section for sealingly attaching said corrugated layer of rubber to said thickened shoulder region of said solid rubber layer and said corrugated layer of rubber has a drive shaft cover surrounding said drive shaft and abutting said tubular sleeve.

14. The massager according to claim 13, wherein said thickened shoulder region includes a one-way valve for providing a higher than atmospheric pressure between said cover assembly and said core.

15. The massager according to claim 14, wherein said drive shaft cover includes a sealing projection at said drive shaft for maintaining the higher than atmospheric pressure in said cover assembly.

16. In combination with a rotary drive, a massager for attachment to the drive, the massager comprising:

a massager head including:

a substantially spherical motion-core having an uninterrupted curved surface section, beveled surfaces and balls disposed at said beveled surfaces;

a cover assembly surrounding said motion-core, said cover assembly including a solid rubber layer, a sponge layer attached to said solid rubber layer, a cotton fabric cover, and a corrugated layer of rubber attached to said solid rubber layer, said corrugated rubber layer being slideable on said uninterrupted curved surface section;

a drive shaft connected to said motion-core;

a connector for attaching the massager to the drive;

an attachment for transferring rotary motion from the drive to said drive shaft.

17. The massager according to claim 16, further comprising a tubular sleeve surrounding said drive shaft, said tubular sleeve abutting said corrugated rubber layer.

18. In combination with a rotary drive, a massager for attachment to the drive, the massager comprising:

a massager head including:

a substantially spherical static-core having grooves defining high spots and an uninterrupted curved surface section;

a cover assembly surrounding said static-core, said cover assembly including a solid rubber layer, a sponge layer attached to said solid rubber layer, a cotton fabric cover, and a corrugated layer of rubber attached to said solid rubber layer, said corrugated rubber layer being slideable on said uninterrupted curved surf ace section;

a drive shaft connected to said static-core;

a connector for attaching the massager to the drive;

an attachment for transferring rotary motion from the drive to said drive shaft.

19. The massager according to claim 18, further comprising a tubular sleeve surrounding said drive shaft, said tubular sleeve abutting said corrugated rubber layer.

20. In combination with a rotary drive, a massager for attachment to the drive, the massager comprising:

a massager head including:

a substantially spherical core having an uninterrupted curved surface section;

a drive shaft connected to said spherical core;

a cover assembly enclosing said spherical core, said cover assembly being sealingly connected to said drive shaft for creating a sealed void between said spherical core and said cover assembly;

a connector for attaching the massager to the drive; and an attachment for transferring rotary motion from the drive to said drive shaft.

21. The massager according to claim 20, wherein said cover assembly has a corrugated layer that is slideable on said uninterrupted curved section.

* * * * *